US005897404A

United States Patent [19]

Goodman et al.

[11] Patent Number: 5,897,404

[45] Date of Patent: Apr. 27, 1999

[54] SOCKET TERMINAL

[75] Inventors: Joseph Ray Goodman, Kernersville; Jimmy Glenn Grubbs, Winston-Salem; Richard Eric Hasz, Ramseur; David Maurice Wolla, Winston-Salem, all of N.C.

[73] Assignee: The Whitaker Corporation, Wilmington, Del.

[21] Appl. No.: 08/719,852

[22] Filed: Sep. 30, 1996

[51] Int. Cl.[6] ..... H01R 13/00

[52] U.S. Cl. ..... 439/843; 439/851

[58] Field of Search ..... 439/839–843, 439/851, 852, 856, 857

[56] References Cited

U.S. PATENT DOCUMENTS

| | | | |
|---|---|---|---|
| 4,133,599 | 1/1979 | Powell | 339/258 R |
| 4,168,878 | 9/1979 | Risser et al. | 339/217 S |
| 4,262,987 | 4/1981 | Gallusser et al. | 339/258 R |
| 4,431,256 | 2/1984 | Piscitelli et al. | 339/258 R |
| 4,461,531 | 7/1984 | Davis et al. | 339/258 R |
| 4,493,527 | 1/1985 | Piscitelli et al. | 339/258 R |
| 4,530,560 | 7/1985 | Weidler | 339/97 R |
| 4,540,234 | 9/1985 | Konnemann et al. | 339/259 R |
| 4,550,972 | 11/1985 | Romak | 339/256 R |
| 4,566,752 | 1/1986 | Hemmer | 339/262 R |
| 4,572,606 | 2/1986 | Neumann et al. | 439/843 |
| 4,655,526 | 4/1987 | Shaffer | 339/74 R |
| 4,780,097 | 10/1988 | Piscitelli | 439/843 |
| 4,934,964 | 6/1990 | Mazelle | 439/843 |
| 5,067,916 | 11/1991 | Denlinger et al. | 439/857 |
| 5,106,329 | 4/1992 | Maeshima et al. | 439/851 |
| 5,108,318 | 4/1992 | Sakurai et al. | 439/744 |
| 5,186,663 | 2/1993 | Wymelenberg | 439/843 |
| 5,199,910 | 4/1993 | Kahle et al. | 439/843 |
| 5,302,145 | 4/1994 | Spinnato et al. | 439/843 |
| 5,322,459 | 6/1994 | Spinnato | 439/843 |
| 5,419,723 | 5/1995 | Villiers et al. | 439/843 |
| 5,486,124 | 1/1996 | Wandler | 439/843 |
| 5,516,310 | 5/1996 | Sawada | 439/843 |
| 5,599,212 | 2/1997 | Sawada | 439/843 |

FOREIGN PATENT DOCUMENTS

| | | | |
|---|---|---|---|
| 0 133 377 | 2/1985 | European Pat. Off. . | |
| 0 568 927 A1 | 11/1993 | European Pat. Off. | H01R 13/187 |
| 946 363 | 8/1956 | Germany | 439/843 |

*Primary Examiner*—Gary Paumen
*Assistant Examiner*—Tho D. Ta
*Attorney, Agent, or Firm*—Mary K. Van Atten

[57] ABSTRACT

The invention comprises an electrical contact having a body with a crimping section and a base with resilient contact fingers extending forwardly from the base. The base has a tapered cylindrical section. A sleeve is secured over the base and the resilient contact fingers. The sleeve engages the tapered cylindrical section in an interference fit to secure the sleeve thereon.

10 Claims, 3 Drawing Sheets

SOCKET TERMINAL

FIELD OF THE INVENTION

The invention relates to a socket terminal having a protective sleeve fitted thereround.

BACKGROUND OF THE INVENTION

It is common to provide an electrical contact having resilient contact fingers with a protective sleeve secured around the contact fingers. The protective sleeve provides protection for the resilient fingers against sideways forces and also protects the resilient fingers against overstress during mating with a pin contact. Often this sleeve is secured over a cylindrical base portion of the contact and is secured by crimping a back end of the sleeve around the central cylindrical base portion.

U.S. Pat. No. 5,516,310 shows a socket terminal having a cylindrical base portion with resilient contact fingers and a sleeve secured over the contact fingers. The sleeve has a series of dimples and the base portion of the contact has a series of grooves. The sleeve is received onto the contact so that the dimples are received within the grooves thereby securing the sleeve to the contact.

One problem that occurs in the prior art contact assemblies is that when the sleeve is secured to the contact the resilient fingers can be pushed out of proper alignment during the securing process. Other problems that occur are that the sleeve and the contact fingers are not properly aligned with each other or that the gap between the resilient fingers can be changed. What is needed is a sleeve which can be secured over the resilient fingers to the base of the contact without jarring or moving the resilient fingers thereby insuring that they are properly aligned within the sleeve and that the sleeve is properly aligned with the resilient fingers.

SUMMARY OF THE INVENTION

The invention comprises an electrical contact having a body with a crimping section and a base with resilient contact fingers extending forwardly from the base. The base has a tapered cylindrical section. A sleeve is secured over the base and the resilient contact fingers. The sleeve engages the tapered cylindrical section in an interference fit to secure the sleeve thereon.

The invention further comprises an electrical connector with a body having a wire connecting section, a base, and resilient contact fingers. The base is generally cylindrically shaped and is tapered from a rearward portion of the contact inward to a mating end of the contact. A sleeve is received over the base and the resilient contact fingers to protect the resilient contact fingers, the sleeve being received in an interference fit over the base to secure the sleeve to the base.

BRIEF DESCRIPTION OF THE DRAWINGS

An embodiment of the present invention will now be described with reference to the accompanying drawings, in which.

DETAILED DESCRIPTION OF THE INVENTION

Figures 1, 2:
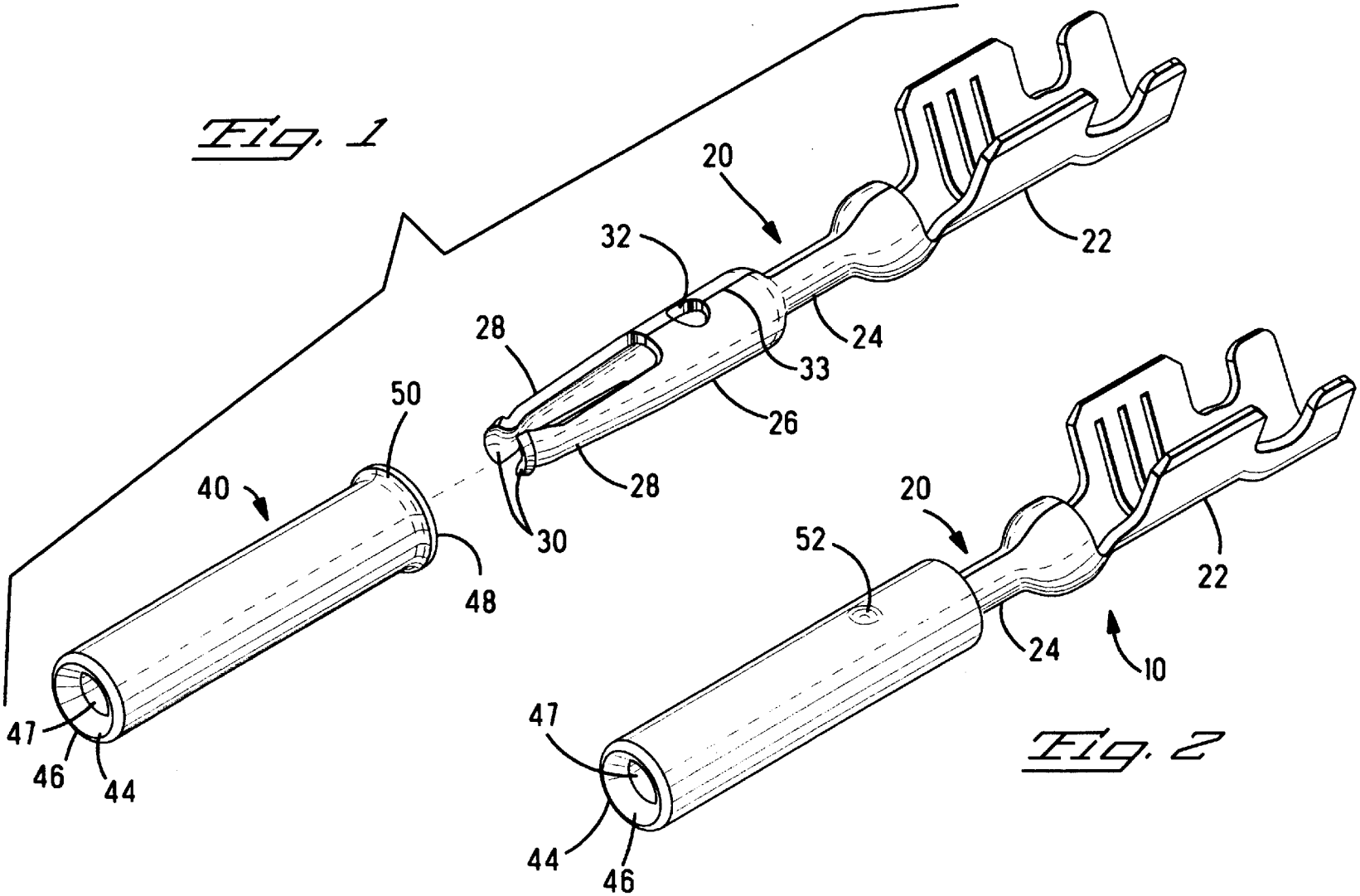
FIG. 1 is an exploded isometric view of the contact and sleeve of the present invention.
FIG. 2 is an assembled view of the contact of the present invention.

FIG. 1 shows the contact assembly 10 of the present invention The contact assembly comprises the contact 20 and the sleeve 40. The contact has a crimping section 22 for securing the contact to a wire, as is generally known in the art. The contact 20 also has an intermediate section 24 which is shown here as a necked down, narrower section. This necked down section 24 permits sufficient space for features integral with the connector housing for securing or aligning the contact within the connector housing, not shown. Forward of the intermediate section 24 is a base 26. Extending from the base 26 are two resilient contact fingers 28 which are angled toward each other. The contact fingers 28 each have contact sections 30 for receiving a pin therebetween, not shown. Forward of the contact section 30 are flared out portions which guide the mating pin into proper position between the contact fingers 28, as is well known in the art. The contact 20 shown in FIG. 1 is illustrated having only two resilient contact fingers 28, however it is possible that the contact could have various numbers of resilient fingers to provide electrical contact to the mating pin. The base 26 has two holes 32, only one of which is shown in FIG. 1. There is another hole 32 disposed on an opposite side of the base, opposite to the hole on the top of the base.

Figure 6:
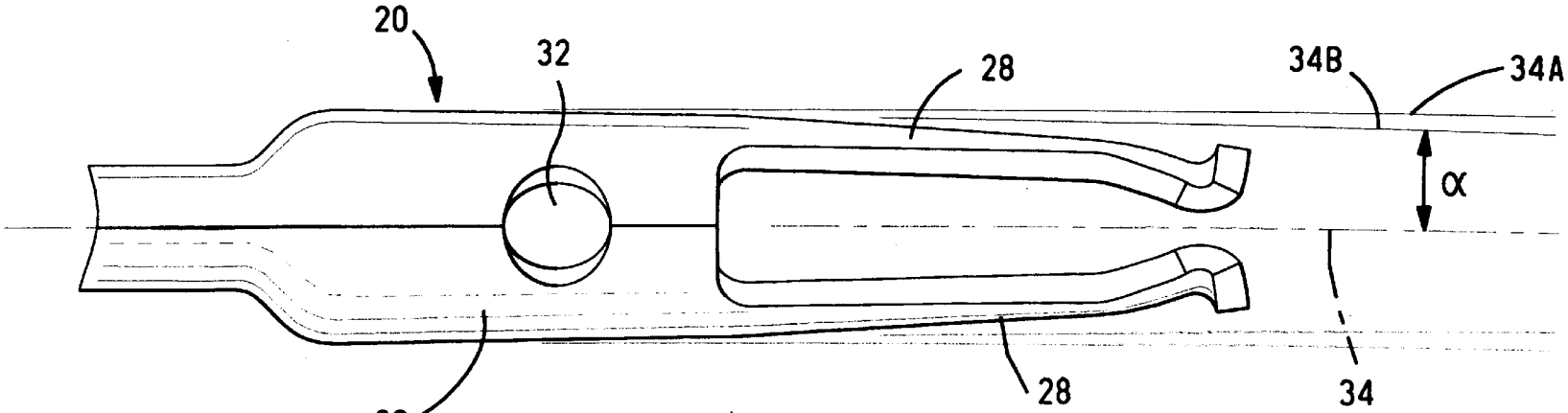
FIG. 6 shows a side view of the contact of the present invention.

The base 26 has a tapered cylindrical section, as is shown in FIG. 6. Extended lines 34A and 34B shown in FIG. 6 illustrate the taper of base section 26. Angle $\alpha$ illustrates that line 34B and center-line 34 are not parallel. FIG. 6 shows a center line 34 of the electrical contact and it can be seen that the base 26 is tapered inwardly from the rearward end of the base, adjacent intermediate section 24, to the resilient contact fingers 28. The importance of the tapered cylindrical section of the base will be described more fully hereinafter.

Figure 3:
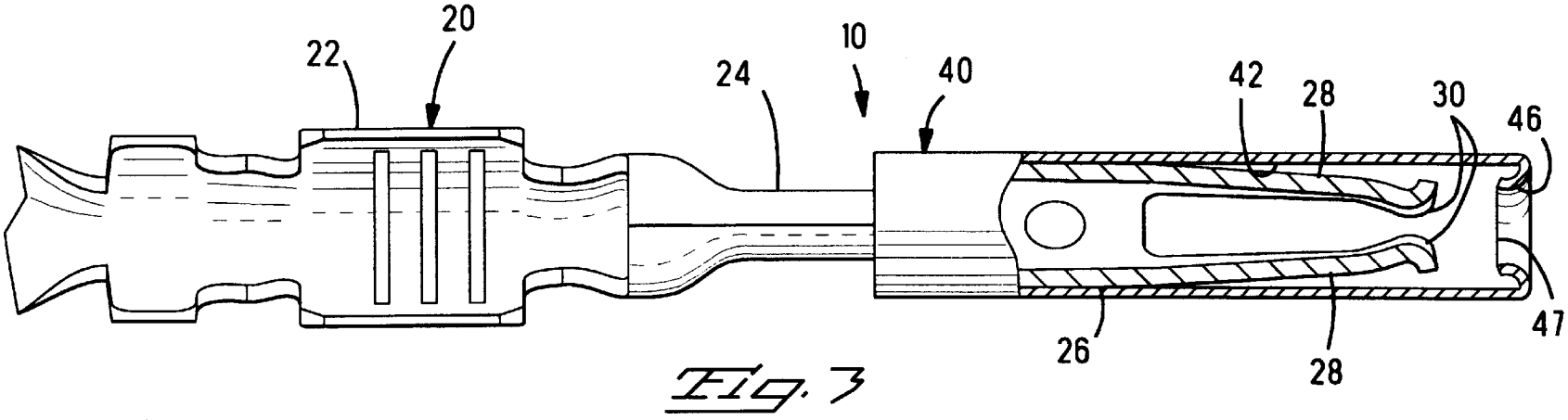
FIG. 3 is a top view of the contact showing a partial cross section of the resilient fingers secured within the sleeve.

The sleeve 40 is an elongated member having a hollow center 42, shown in FIG. 3, which extends from a mating end 44 to a securing end 48. The mating end 44 has tapered lead-in surfaces 46 which provide a lead in for the mating pin. The tapered lead-in surfaces 46 extend completely around the periphery of an entrance hole 47 into the hollow center 42 of the sleeve 40. At the securing end 48 of the sleeve there is a flared out portion 50 which is used to provide alignment of the sleeve 40 over the resilient contact fingers 28 and socket base, within the assembly tool during assembly of the contact assembly Once the sleeve 40 is secured onto the contact 20, dimples 52 are made on the outer surface of the sleeve which are aligned with the holes 32 on the base to secure the sleeve 40 to the contact 20 in the direction parallel to the direction of the socket while the interference fit secures the sleeve in a direction perpendicular to the axis of the socket.

FIG. 3 shows the assembled connector assembly of the present invention with a partial cross sectional of the sleeve 40 and the contact fingers. As can be seen in FIG. 3 the contact fingers and the base portion are received within the hollow center 42 of the sleeve 40. The end of the resilient contact fingers 28 are aligned with opening 47 along the meeting end 44 of the sleeve, therefore when a mating pin is inserted, it is first led in by the lead-in surfaces 46 into the flared out portion and the contact section 30 of the resilient contact fingers 28.

Figure 4:
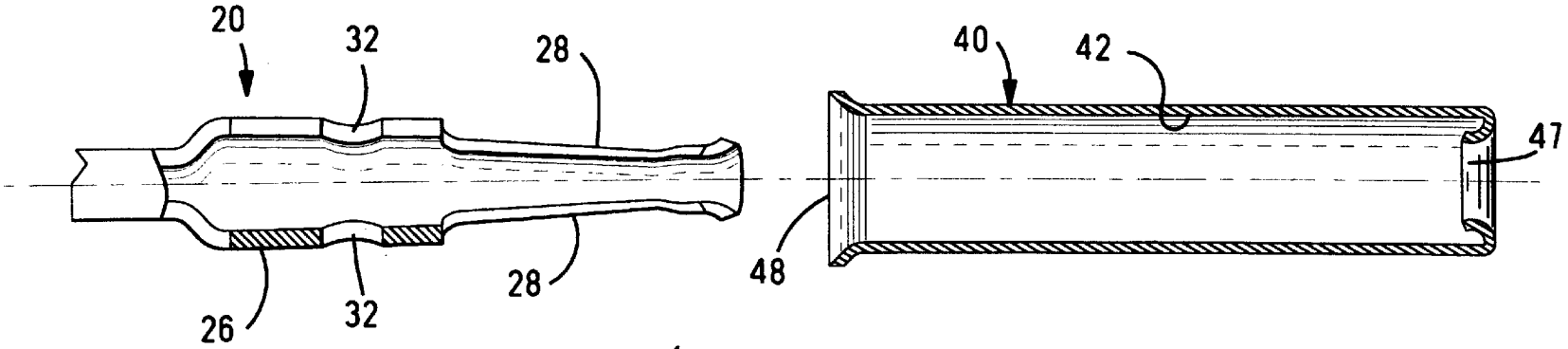
FIG. 4 shows the insertion of the sleeve onto the contact.

FIG. 4 shows the assembly of the sleeve 40 onto the contact 20. The sleeve 40 is inserted with the securing end 48 facing the contact 20. As the sleeve is moved leftward, as shown in FIG. 4, the flare is removed by the assembly tooling as it is pushed over the resilient fingers and onto the base 26 the inner surface of the sleeve will engage the base 26 along the tapered portion of the base. The inner surface of the sleeve will not engage the resilient contact fingers 28 because they are tapered from the base and are narrower than the inner surface of the sleeve. As the sleeve is inserted further onto the base portion 26 of the contact, the sleeve 40 will encounter additional resistance because of the tapered section of the base, thereby providing more and more force against the insertion of the sleeve. The sleeve is secured onto the base section 26 of the contact because of the tight interference fit between the tapered section of the base with the inner portion of the sleeve. Because most of the forces are exerted along the rearward portion of the base 26, that is the portion of base closest to the crimping section, due to the taper of the base 26, the forces exerted between the sleeve 40 and the base 26 are not transferred to the resilient contact fingers 28, thereby ensuring that the resilient contact fingers are not pushed together and thus preserve the appropriate gap between the contact fingers.

Figure 5:
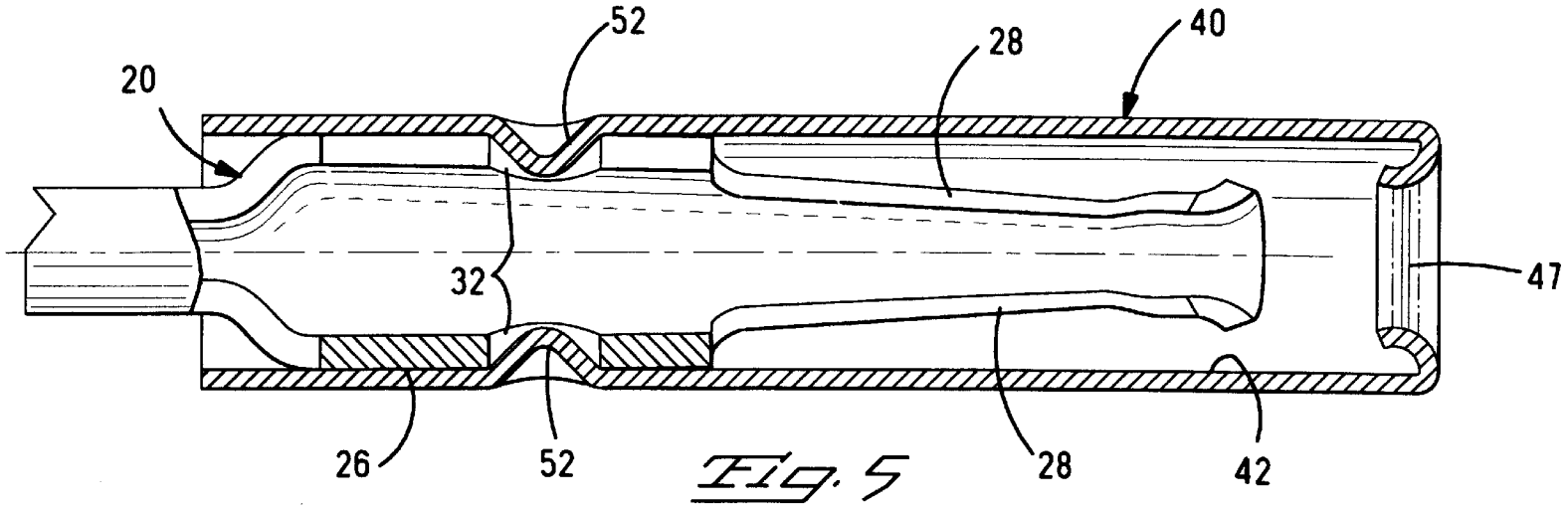
FIG. 5 shows a cross sectional view showing the fully assembled contact.

Once the sleeve is completely received onto the base section 26, as in shown in FIG. 5, so that the end of the sleeve is received beyond the base section, dimples 52 are formed along the sleeve 40, aligned with the holes 32, thereby completely securing the sleeve onto the base section 26 and onto the contact 20.

The assembly process ensures proper location of the sleeve 40 as it is pressed onto the contact 20. The interference fit between the sleeve 40 and the base 26 provides the primary retention between the sleeve and the contact. The dimples 52 are primarily to reinforce the sleeve retention.

The base 26 acts as a noncompliant member as the seam 33 is butted closed over the length thereof, see FIG. 1, and the base 26 is thicker and stronger than the sleeve 40. The sleeve 40 deforms over the base 26 developing hoop stress and storing energy which maintains a tight interference fit between the sleeve 40 and the base 26. Since the interference is confined to only the base portion 26 and due to the noncompliant nature of the base, no forces or translations are transferred to the resilient fingers 28.

The contact assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An electrical contact, comprising:

a body having a crimping section, resilient contact fingers and a base disposed therebetween, the base having a smooth barrel section of substantially circular cross-section tapered inwardly in a forward direction, the resilient contact fingers extending forwardly from the base and tapered inwardly from the base toward contact sections of the contact fingers; and a sleeve secured over the base and the resilient contact fingers where the sleeve engages the tapered barrel section in an interference fit to secure the sleeve thereon.

2. The electrical contact of claim 1, wherein the resilient contact fingers are tapered inwardly from the tapered barrel section toward contact sections of the contact fingers, thereby providing a contact mating interface for receiving a pin.

3. The electrical contact of claim 2, wherein the sleeve engages the base to secure the base thereto and the contact fingers are received within the sleeve without engaging the sleeve because of the inward taper.

4. The electrical contact of claim 1, wherein the base has a hole and the sleeve has a dimple aligned with the hole thereby further securing the sleeve to the base.

5. The electrical contact of claim 4, wherein the base has a second hole disposed opposite to the hole and the sleeve has a second dimple aligned with the second hole to further secure the sleeve to the base.

6. An electrical connector comprising:

a body having a wire connecting section, a base, and resilient contact fingers, the base disposed between the wire connecting section and the resilient contact fingers, the base being generally cylindrically shaped and having a substantially circular cross-section, said base being tapered from a-rearward portion of the base inward to the resilient contact fingers; and a sleeve received over the base and the resilient contact fingers to protect the resilient contact fingers, the sleeve being received in an interference fit over the base to secure the sleeve to the base.

7. The electrical contact of claim 6, wherein the base has a hole and the sleeve has a dimple aligned with the hole thereby further securing the sleeve to the base.

8. The electrical contact of claim 6, wherein the resilient contact fingers are tapered inwardly from the tapered cylindrical section toward contact sections of the contact fingers, thereby providing a contact mating interface for receiving a pin.

9. The electrical contact of claim 8, wherein the sleeve engages the base to secure the base thereto and the contact fingers are received within the sleeve without engaging the sleeve because of the inward taper.

10. The electrical contact of claim 9, wherein the base has a second hole disposed opposite to the hole and the sleeve has a second dimple aligned with the second hole to further secure the sleeve to the base.

* * * * *